US009054817B2

(12) United States Patent
Carey

(10) Patent No.: US 9,054,817 B2
(45) Date of Patent: Jun. 9, 2015

(54) APPARATUS AND METHOD FOR SELECTING GEOGRAPHICAL AREA INFORMATION AT A WEATHER BAND, OR OTHER, RADIO DEVICE

(75) Inventor: Richard Carey, Fort Worth, TX (US)

(73) Assignee: RadioShack Corporation, Fort Worth, TX (US)

( * ) Notice: Subject to any disclaimer, the term of this patent is extended or adjusted under 35 U.S.C. 154(b) by 1398 days.

(21) Appl. No.: 11/302,725

(22) Filed: Dec. 14, 2005

(65) Prior Publication Data

US 2007/0135108 A1 Jun. 14, 2007

(51) Int. Cl.

| | |
|---|---|
| ***G08B 1/08*** | (2006.01) |
| ***H04H 20/59*** | (2008.01) |
| ***H04H 60/51*** | (2008.01) |
| ***H04H 60/71*** | (2008.01) |

(52) U.S. Cl.

CPC ..... *H04H 20/59* (2013.01); *H04H 60/51* (2013.01); *H04H 60/71* (2013.01)

(58) Field of Classification Search

USPC ..... 455/414.3, 414.2, 456.2, 414.1

See application file for complete search history.

(56) References Cited

U.S. PATENT DOCUMENTS

| | | | | |
|---|---|---|---|---|
| 4,969,209 | A | 11/1990 | Schwob | |
| 6,177,873 | B1 * | 1/2001 | Cragun | 340/601 |
| 6,728,522 | B1 * | 4/2004 | Marrah et al. | 455/179.1 |
| 7,053,780 | B1 * | 5/2006 | Straub et al. | 340/601 |
| 2003/0193394 | A1 * | 10/2003 | Lamb | 340/539.28 |
| 2004/0235416 | A1 | 11/2004 | Chan et al. | |
| 2005/0136983 | A1 * | 6/2005 | Agapi et al. | 455/566 |
| 2007/0069946 | A1 * | 3/2007 | Kaplan et al. | 342/357.09 |

* cited by examiner

*Primary Examiner* — Rafael Pérez-Gutiérrez
*Assistant Examiner* — Joshua Schwartz

(57) ABSTRACT

Apparatus, and an associated method, for a weather band radio that annunciates anomaly conditions. The radio has a set-up mode permitting a user to enter a home geographical area and also associated areas within a selected proximity to the home geographical area. When a National Weather Service SAME message is received at the radio that identifies the home geographical area or any of the associated geographical areas, the radio generates an alert.

25 Claims, 4 Drawing Sheets

APPARATUS AND METHOD FOR SELECTING GEOGRAPHICAL AREA INFORMATION AT A WEATHER BAND, OR OTHER, RADIO DEVICE

The present invention relates generally to a manner by which to personalize a radio device, such as a weather band radio operable to detect a SAME (Specific Area Message Encoding) message, so that the radio device annunciates anomaly messages related to a selected geographical area of interest. More particularly, the present invention relates to apparatus, and an associated method, that permits selection of a home geographical area of the radio device and that identifies, and permits selection of, additional geographical areas in proximity to the home geographical area, the home geographical area and additional geographical areas forming the selected geographical area of interest.

When an anomaly message is broadcast that pertains to any part of the selected geographical area of interest, the radio generates an annunciation to alert a listener of the radio device of the anomaly condition.

BACKGROUND OF THE INVENTION

A weather band radio operates to receive broadcasts of weather-related, and other, information. A listener of the weather band radio is provided with the information contained in the broadcasts. By listening to the broadcasts, the listener of the weather band radio is provided with early warning of, e.g., weather anomalies, such as imminent, severe weather. The listener, by being given early warning of the weather anomaly, is able better to take appropriate action to guard against dangers associated with the weather anomaly.

Generally, governmental bodies operate the radio networks from which the weather-related, or other, information is broadcast. For instance, in the United States, the National Weather Service (NWS), an agency of the National Oceanic and Atmospheric Administration (NOAA) of the United States Department of Commerce, overseas the weather radio broadcast network. The broadcasts provided by the National Weather Service first commenced in the late 1950s. Subsequently, the service provided by the National Weather Service was named the NOAA Weather Radio (NWR). The broadcasts are transmitted in the very high frequency (VHS) radio band that extends between 162.400 MHz and 162.550 MHz. Seven channels are defined within the allocated frequency band. Transmitting stations located in various geographical regions of the country broadcast weather-related, and other, information.

The types, and content, of the broadcast information is technology dependent. As communication technologies have evolved, the content of the broadcasts of changed. In the 1960s, for instance, the NWR broadcast a single tone at 1050 Hz followed by a message relating to a potentially dangerous event. The single tone is sometimes referred to as a warning alarm tone. Conventional weather band radios are sometimes constructed to detect the warning alarm tone and, in response, to cause the weather band radio to aurally, or otherwise, annunciate the detected tone. As communication technologies evolved to permit the introduction of digital communication techniques, in the 1980s, the National Weather Service implemented a broadcast scheme that includes digital codes. Broadcast of a tone that alerts the existence of a weather, or other, anomaly together with a digital code has formed, since such time, the national standard of broadcast by the National Weather Service.

Weather band radio receivers are constructed now to detect the digital messages that are broadcast. The digital codes are formatted according to a standardized format, referred to as NWR Specific Area Message Encoding (NWR SAME).

An NWR SAME message includes various fields. The fields of the message include a field that identifies the geographic region, or area, associated with an accompanying alert message. Many conventional weather band radios are capable of detecting the digital message and the contents of the field that identifies the geographic region. If desired, the radio operates to generate an alert only when the field of the NWR SAME message identifies a geographic region of interest to the radio. To provide such operation, however, the radio must be personalized so that the radio becomes associated with a geographical area, i.e., the geographical area of interest. The identifier forms a code forming a six-digit sequence. The code identifies an area, e.g., by its state, its county, and portion of the county. While a conventional weather band radio provides for user entry of the code, or even a mneumonic associated with the code, existing weather band radios generally do not provide an easy manner by which to identify multiple geographical areas of interest and, if provided, multiple coded sequences or associated mneumonics must be entered.

If the weather band radio is to be operated close to a geographical boundry, such as close to a county or state line, the listener of the weather band radio might well have an interest in being alerted to anomaly conditions in more than one geographical area. Or, if the weather band radio is mobile or is to be positioned at successive times at different locations throughout a region, being alerted to anomaly conditions in more than one geographical areas might also be of interest.

If a manner could be provided by which better to facilitate operation of a radio to annunciate anomaly conditions identified in more than one geographical area, improved listener acceptance of the radio and improved usability of the radio would be provided.

It is in light of this background information related to annunciating radios, such as weather band radios, that the significant improvements of the present invention have evolved.

SUMMARY OF THE INVENTION

The present invention, accordingly, advantageously provides apparatus, and an associated method, by which to personalize a radio device, such as a weather band radio operable to detect a SAME message, so that the radio device annunciates anomaly messages related to a selected geographical area of interest.

Through operation of an embodiment of the present invention, a manner is provided that permits selection of a home geographical area of the radio device and that identifies and permits selection of additional geographical areas in proximity to the home geographical area.

In one aspect of the present invention, when an anomaly message is broadcast that pertains to the home geographical area or any selected additional geographical area, the radio generates an annunciation to alert a listener of the radio device of the existence of the anomaly condition.

In another aspect of the present invention, an operational set-up procedure is carried out to set up operation of the radio device to alert reception of SAME messages associated with selected geographical areas. Selection is first made of the home geographical area associated with the radio device. The home geographical area is selected pursuant to input actuations made at the radio device, such as pursuant to a prompting scheme in which input information is provided to the radio device to identify the country and then the state or province in which the radio device is to be operated. Upon selection of the state or province in which the radio device is to be operated, a prompt for selection of a county, or other jurisdictional area, forming a subset of the state or province is generated, and selection is made of one or more of the sub-areas of the state or province. The prompt forms, for instance, a listing that is displayed on a user display responsive to which selection is made of the sub-area of the state or province.

In another aspect of the present invention, once acceptance of selection of a home geographical area is made, the possible associated geographical areas are automatically determined. Determination is made using a proximity criteria, such as an adjacency criteria or a range criteria. When an adjacency criteria is utilized, the possible associated geographical areas are geographical areas that are adjacent to the home geographical area. And, when a range criteria is utilized as the proximity criteria, geographical areas within a selected range of the home geographical area are selectable, irrespective of adjacency. A combination of adjacency and range criteria, or other types of proximity criteria, to identify possible associated geographical areas.

Once the possible associated geographical areas are identified, a listing is created and displayed on a user display, permitting selection of all, or selected ones, of the possible associated geographical areas. Upon acceptance of the selection, the home geographical area and one or more associated area geographical areas define a region of interest to a listener of the radio. Subsequently, the radio operates in conventional manner to receive broadcast signals and the digital messages contained therein, namely, the NWR SAME messages. When a message includes the identity of the home geographical area or an associated geographical area, i.e., the identity of any area within the region of interest, an annuciator annunciates the reception to alert a listener of the received signal and the associated anomaly condition.

The listener of the radio is not limited to receiving alerts pertaining to a single home geographical area, but rather an entire region including the home geographical area and one or more associated geographical areas. And, user selection of the associated areas is easily made as possible associated geographical areas are automatically determined responsive to selection of the home geographical area.

In these and other aspects, therefore, apparatus, and an associated method, is provided for a radio device operable to receive a signal. The signal selectably has a component that identifies a weather anomaly and has a geographical identifier of a first geographical area. A home area selection acceptor is configured to accept selection of a home geographical area to be associated with the radio device. An associated area selection acceptor is adapted to receive an indication of the home geographical area whose selection is accepted by the home area selection acceptor. The associated area selection acceptor is configured to accept selection of at least a first associated area geographical area that is associated with the home geographical area.

A more complete appreciation of the present invention and the scope thereof can be obtained from the accompanying drawings that are briefly summarized below, the following detailed description of the presently-preferred embodiments of the present invention, and the appended claims.

DETAILED DESCRIPTION

Figure 1:
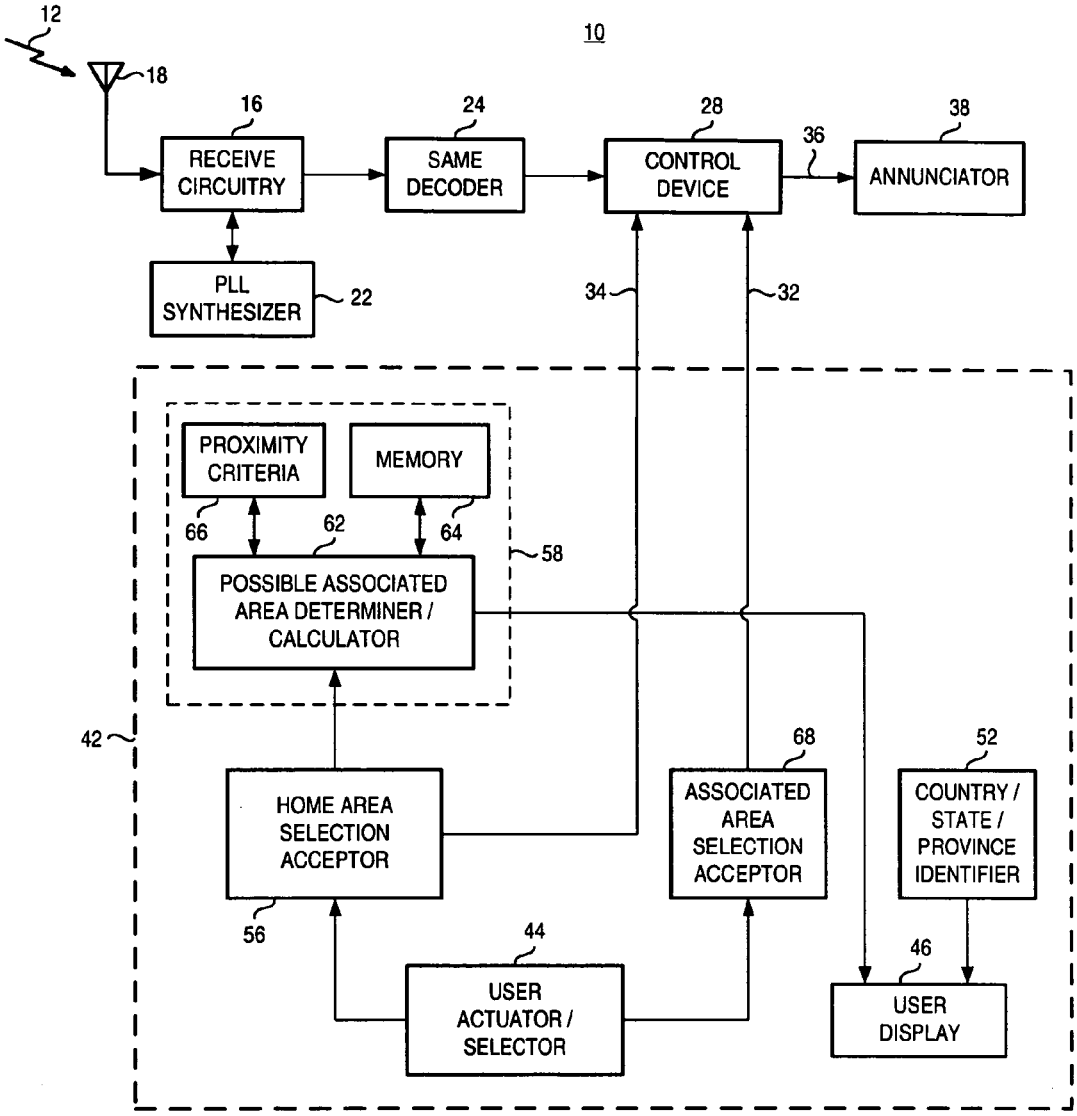
FIG. 1 illustrates a functional block diagram of a radio device operable pursuant to an embodiment of the present invention.

Referring first to FIG. 1, a weather band radio, shown generally at 10, operates to receive NWR broadcasts when the radio is positioned in an area encompassed by an NWR transmitting station. The arrow 12 shown in the figure is representative of a signal broadcast by an NWR transmitting station. As noted previously, the signal broadcast by the NWR includes an NWR SAME code as part of its transmission.

The radio 10 includes receive circuitry 16 that detects signals, such as the signal 12, transmitted by a transmitting station. The signal, when delivered to the radio is transduced, by an antenna 18, into electrical form and provided to the receive circuitry. The radio here also is coupled to a PLL (Phase Lock Loop) synthesizer 22. The PLL synthesizer is coupled to the receive circuitry and operates, amongst other things, to tune the receive circuitry to a selected frequency channel, such as one of the seven NWR channels defined at the 162 MHz frequency band. Once the receive circuitry is tuned to a frequency channel upon which the signal 12 is broadcast, the receive circuitry performs conventional receive operations upon the receive signal such as, e.g., down conversion operations. In the exemplary implementation, when the radio 10 forms the weather band radio capable of receiving the NWR SAME message contained in the signal 12, the radio further includes a SAME message decoder 24 coupled to the receive circuitry 16. The decoder 24 operates to decode the SAME message when forming part of the signal 12 transmitted to the radio. And, decoded messages decoded by the decoder are provided to a control device 28.

The control device 28 controls various features and operations of the radio. Control operations performed by the control device here include, for instance, comparison operations to compare values of the decoded message decoded by the decoder 24 with selected values, here provided by way of the lines 32 and 34. When the values of the decoded message corresponds to values provided on the lines 32 or 34, the control device generates a signal on the line 36 that extends to an annunciator 38. The annunciator, when provided with an appropriate signal on the line 36, generates an aural, or other, alert to alert a listener of the radio of the detection of the message that corresponds to the values provided on the lines 32 and 34.

Pursuant to an embodiment of the present invention, the radio further includes apparatus 42 of an embodiment of the present invention. The apparatus is formed of functional entities implementable in any desired manner, including algorithms executable by processing circuitry.

The apparatus 42 operates to generate values that are provided by way of the lines 32 and 34 to the control device and which are determinative of when the annunciator generates an alert to a listener of the radio. The apparatus operates, in conjunction with user, e.g., listener, input, to define a geographical region of interest of which the values generated on the lines 32 and 34 are representative. When a signal 12 includes an SAME message that identifies a geographical area corresponding to an area of the region of interest, the controller causes the annunciator to generate the alert.

The apparatus includes a user interface formed of a user actuator 44 and a user display 46. The user actuator forms, for instance, an input keypad containing actuation keys that are actuatable by a listener or other user of the radio. And, the user display forms any appropriate display element, such as a liquid crystal display.

The apparatus 42 is operable in a set-up mode in which the geographical region of interest is defined. In the exemplary implementation, upon powering of the radio and entry into the set-up mode, the user is prompted, through operation of a large-area identifier, to identify and select a country and state or province in which the radio is to be operated. In the exemplary implementation, upon entry into the set-up mode, the identifier 52 causes display on the user display of available countries, e.g., the United States and Canada, in which the radio is operable. Responsive to display on the user display of the listing of available countries, the user of the radio makes selection from amongst the available countries. And, the identifier, upon detection of the selection made by the user by way of the user actuator, causes a listing of states or provinces of the selected country to be listed and displayed on the user display. The user of the radio is further prompted to make selection of the listed states or provinces. And, once selection is made of the state or province selected by the user, the user is further prompted to select a county of interest within the selected state or province. The user makes selection, and an indication of the selection is provided to a home area selection acceptor 56. The selection acceptor accepts the selection made by the user by way of the user interface. And, an indication of the accepted selection is provided to an associated area geographical area identifier 58. The identifier 58 includes a possible associated area determiner and calculator 62, a memory element 64, and a proximity criteria indicator 66.

The determiner and calculator 62 operates to make calculations to identify possible associated areas within a selected proximity to the home area whose selection has been accepted by the selection acceptor 56. The determiner and calculator accesses the memory 64 and the proximity criteria indicator 66 pursuant to performance of the determinations and calculations. In one implementation, the possible associated areas, associated with the selected home geographical area comprise areas that are adjacent to the home geographical area. When, e.g., the home geographical area comprises a county, the possible associated areas comprise counties that are adjacent to the home geographical area. When the proximity criteria comprises a distance criteria, i.e., a range criteria, the possible associated areas are areas within a selected distance from the home geographical area. When, e.g., the selected home geographical area comprises a county, counties within a selected proximity, i.e., within a selected range, of the home geographical area form the possible associated area geographical areas.

In the exemplary implementation, when the proximity criteria comprises a range criteria, coordinates of the home geographical area and coordinates of other geographical areas are used to determine the range. The coordinates of the geographical area comprise, for instance, the centers of the geographical areas, and the coordinates are stored at the memory element 64. Pursuant to calculations, the values are retrieved from the memory and range or distance calculations are performed by the calculator 62.

Responsive to the calculations, a set of possible associated area geographical areas is identified, and a listing of the possible areas is caused to be displayed on the user display 46. The user of the radio makes selection of one, more than one, or all, of the possible associated areas through actuation of an actuation key of the selector formed of the user actuator 44. An indication of the selection made by the user is provided to an associated area selection acceptor 68. The selection acceptor accepts selection of the selected associated areas, and generates signals on the line 32 that are provided to the control device 28. Analogously, selections accepted by the selection acceptor 56 of the home geographical area are provided to the control device by way of the line 34. Thereby, the entire region of interest, i.e., the home geographical area and the selected associated area geographical areas are provided to the control device.

Through operation of the apparatus 42, a user-friendly mechanism is provided by which to personalize the radio during its set-up during the set-up mode. The user of the radio is prompted to enter information related to its area of use, as defined by a home geographical area. Upon selection of, and acceptance of the selection of, the home geographical area, possible associated areas in proximity to the selected home geographical area are automatically determined. A user is prompted to select, or otherwise affirm, the associated areas that, together with the home geographical area, define a region of interest. When a signal broadcast by the NWR includes an SAME message that identifies the home or associated geographical areas, the radio is caused to annunciate, thereby to alert the delivery of the message and its associated anomaly.

Figure 2:
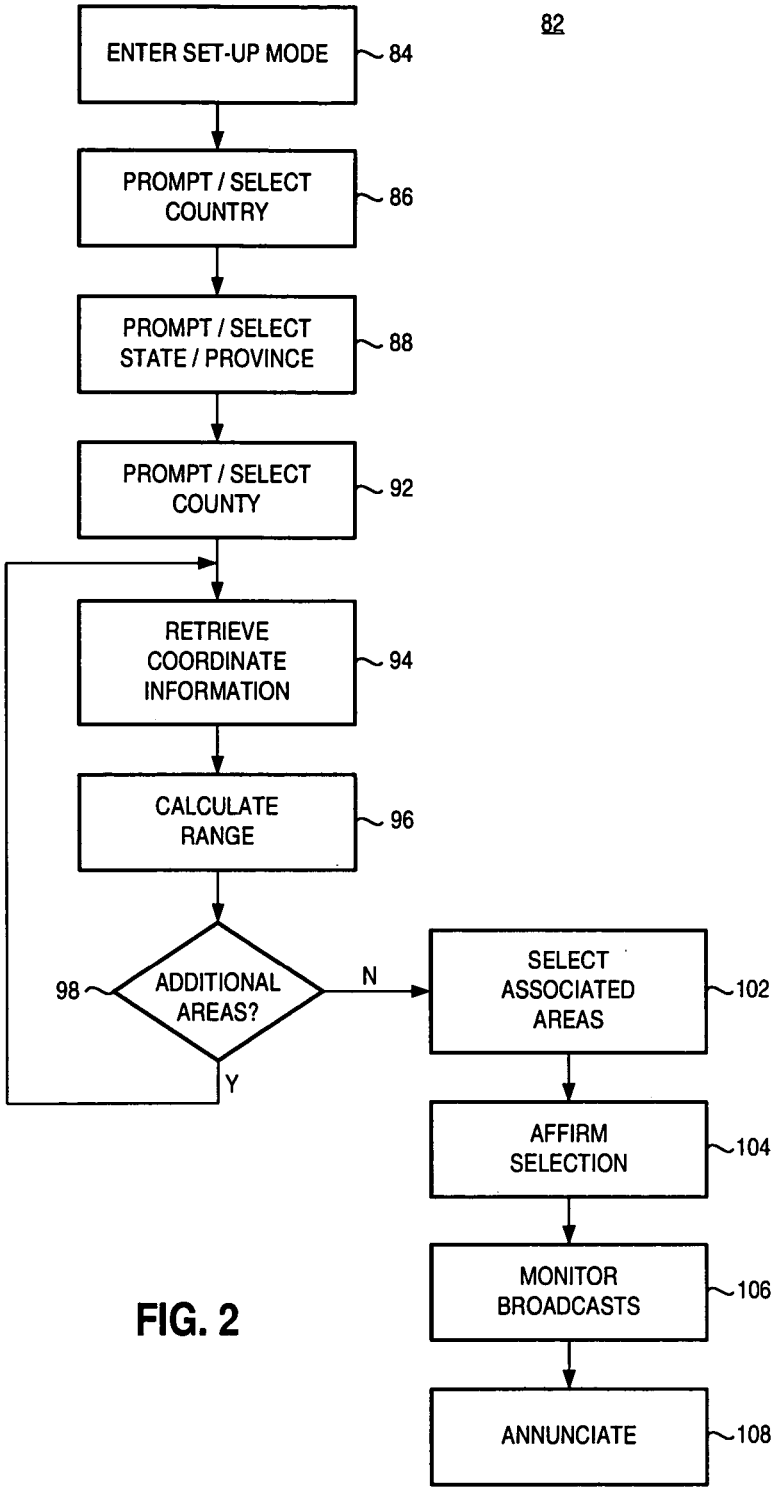
FIG. 2 illustrates a flow chart representative of operation of an embodiment of the present invention.

FIG. 2 illustrates a flow chart, shown generally at 82 representative of operation of an embodiment of the present invention. Operation commences when a radio is caused to enter a set-up mode, here indicated by the block 84. Through a series of prompts and selections, the radio is personalized to a selected home geographical area. Here, the blocks 86, 88, and 92 are representative of prompts and subsequent user selections of country, state or province, and county identifiers of the home geographical area that is to personalize the radio. Subsequent to block 92, the home geographical area has been selected and accepted at the radio.

Then, and as indicated by the block 94, coordinate information of the home geographical area and another geographical area is obtained, such as retrieving such information from a memory element. Then, a range value is calculated that defines the distance between the home geographical area and the other geographical area, as indicated by the block 96. Thereafter, and as indicated by the decision block 98, a determination is made whether coordinates of additional geographical areas are accessible to determine proximity indicia associated with the other geographical areas. If so, the yes branch is taken back to the block 94, and the process is repeated. Otherwise, the no branch is taken to the block 102, and selection is made of geographical areas to be possible associated area geographical areas if the geographical areas are within a selected proximity to the home geographical area. A user is then prompted, as indicated by the block 104, to affirm selection of all, some, one, or none of the possible associated area geographical areas. Once selection is made, the home geographical area and the selected associated area geographical areas, if any, form the region of interest of the radio.

The radio monitors, as indicated by the block 104, NWR signals broadcast thereto and causes annunciation, indicated by the block 108, of messages that include identification of areas corresponding to, or within, the region of interest.

Figure 3:
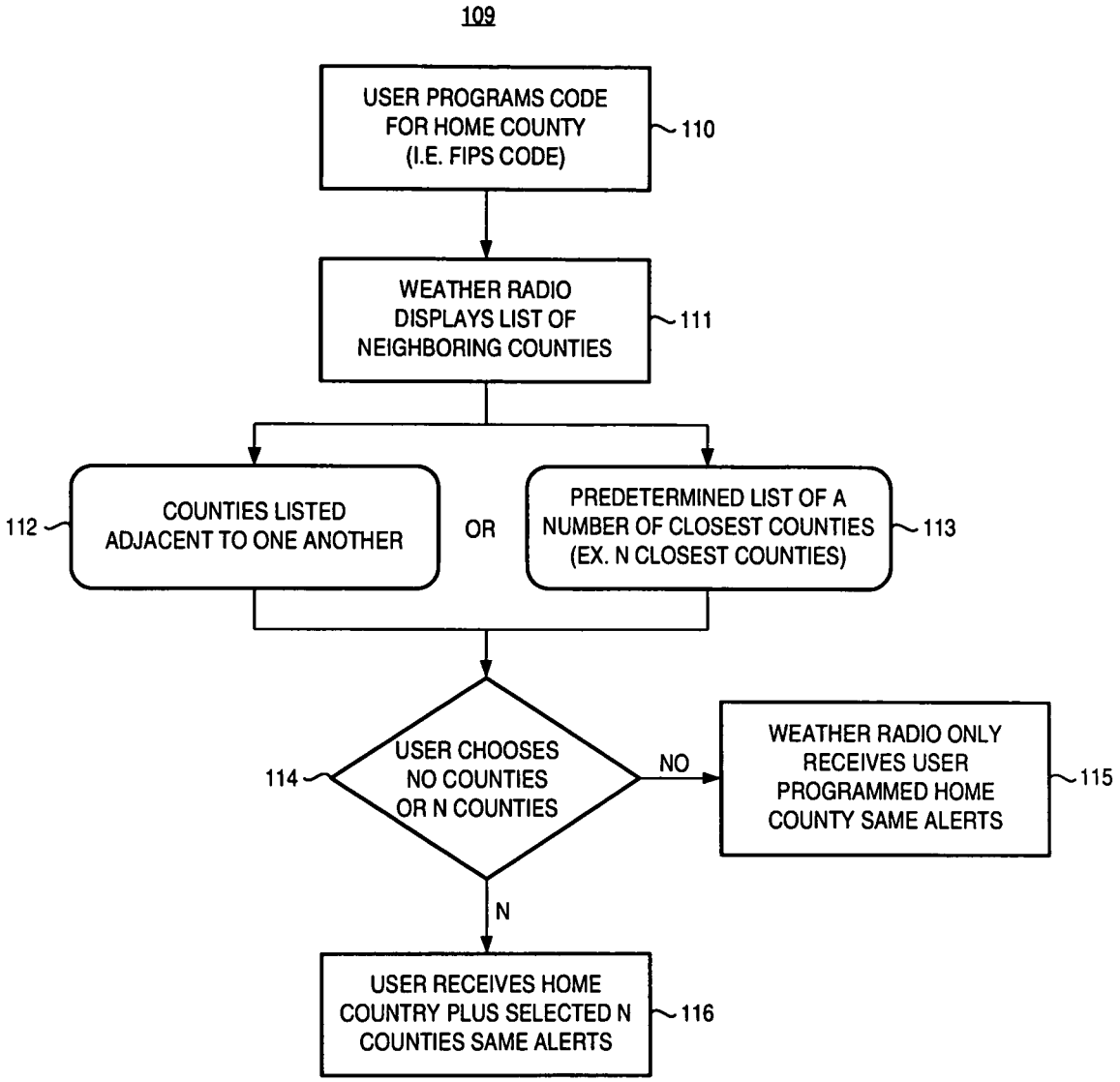
FIG. 3 illustrates a flow chart, also representative of operation of an embodiment of the present invention.

FIG. 3 illustrates a flow chart 109 representative of additional operation of an embodiment of the present invention. Here, the radio is in a set-up mode whereat a user programs, as indicated by the block 110, code for a home county in which the radio is to be operated. The code for the home county is an FIPS code. Then, and as indicated by the block 111, the weather radio displays a list of neighboring counties.

In one manner of operation, and as indicated by the block 112, the counties that are listed are adjacent to one another. In another manner of operation, and as indicated by the block 113, the list is a predetermined list of a selected number of closest counties, viz, N closest counties.

Thereafter, and as indicated by the decision block 114, the user chooses no counties or N counties. If no counties are selected, the no branch is taken to the block 115, and the weather radio only makes use of user programmed home county SAME alerts. Conversely, if N counties are selected, the N path is taken to the block 116. At the block 116, the weather radio makes use of programmed home county SAME alerts as well as the N counties SAME alerts.

Figure 4:
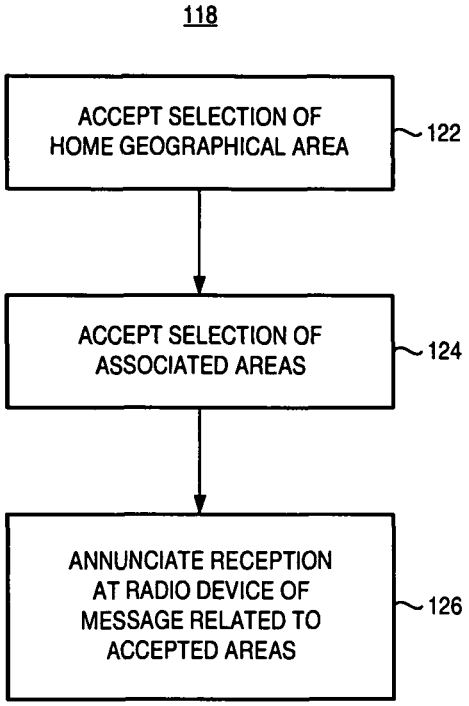
FIG. 4 illustrates a method flow diagram representative of the method of operation of an embodiment of the present invention.

FIG. 4 illustrates a functional block diagram, shown generally at 118, representative of operation of an embodiment of the present invention. The method facilitates operation of a radio device that operates to receive a signal selectably having a component that identifies an anomaly and has a geographic identifier of a first geographical area.

First, and as indicated by the block 122, selection is accepted of a home geographical area to be associated with the radio device. Then, and as indicated by the block 124, selection is accepted of at least a first associated area geographical area that is associated with the home geographical area.

Thereafter, the radio monitors for reception of the signal and, as indicated by the block 126, reception at the radio device of the signal is annunciated when the signal contains the first geographical area when the first geographical area corresponds to at least one of the home geographical areas and the at least the first associated area geographical area.

The radio is not limited to annunciate anomaly conditions of a single home geographical area all the while also not requiring that the user make multiple entries of coded information to identify a plurality of associated geographical areas, associated with the home geographical area.

The previous descriptions are of preferred examples for implementing the invention, and the scope of the invention should not necessarily be limited by this description. The scope of the present invention is defined by the following claims.

What is claimed is:

1. Apparatus for a radio device operable to receive a signal selectably having a component that identifies weather anomalies and geographical areas associated with the weather anomalies, said apparatus comprising:

a home area selection acceptor configured to accept selection of a home geographical area to be associated with the radio device;

an associated area identifier configured to receive an indication of the home geographical area whose selection is accepted by said home area selection acceptor and to thereafter automatically identify possible associated areas in proximity to the selected home geographical area according to a selected proximity criterion;

an associated-area selection acceptor adapted to receive an indication of the home geographical area whose selection is accepted by said home-area selection acceptor, and adapted to receive an indication of possible associated areas identified by said associated area identifier, said associated area selection acceptor configured to accept selection of at least a first possible associated area, each selected possible associated area and the home geographical area forming a region of interest, the signal received by the radio device monitored for a weather anomaly within the region of interest.

2. The apparatus of claim 1 wherein the selected proximity criteria used by said associated area identifier comprises an adjacency indicia, possible associated areas identified by said associated area identifier adjacent to the home geographical area.

3. The apparatus of claim 1 wherein the selected proximity criteria is selectable by a user of the radio device.

4. The apparatus of claim 1 further comprising an annunciator configured to annunciate when the receiver receives the signal having the component that identifies the weather anomaly within the region of interest.

5. The apparatus of claim 1 wherein the signal that the radio device is operable to receive is broadcast by a weather alerting authority and comprises a Specific Area Message Encoding (SAME) message, wherein the component thereof comprises a Federal Information Processing Standards (FIPS) formatted sequence and wherein the home geographical area and the at least the first associated area geographical area are selectably identified in the FIPS formatted sequence.

6. The apparatus of claim 1 further comprising a user actuator actuatable by a user of the radio device, selected actuation of said user actuator by the user of the radio device identifying the selection of the home geographical area that is accepted by said home area selection acceptor.

7. The apparatus of claim 6 wherein additional selected actuation of said user actuator by the user identifies the selection of the selected possible associated area.

8. The apparatus of claim 1 further comprising a user display configured to display indicia identifying geographical areas available for selection as the home geographical area.

9. The apparatus of claim 8 wherein said user display is further configured to display indicia identifying the at least the first possible associated area available for selection as associated area.

10. The apparatus of claim 1 wherein the selected proximity criteria used by said associated area identifier comprises a range indicia, geographical areas identified by said associated area identifier within a selected range of the home geographical area.

11. The apparatus of claim 10 wherein said associated area identifier comprises a calculator configured to calculate a range value of each geographical area relative to the home geographical area, a geographical area having a range value within the selected range forming an associated area geographical area.

12. A method for facilitating operation of a radio device that operates to receive a signal selectably having a component that identifies weather anomalies and geographical areas associated with the weather anomalies, said method comprising the operations of:

accepting selection of a home geographical area to be associated with the radio device;

automatically identifying possible associated areas in proximity to the home geographical area selected during said accepting selection of a home geographical area, the possible associated areas being identified according to a proximity criterion;

accepting selection of at least a first possible associated area, each selected possible associated area and the home geographical area forming a region of interest; and annunciating reception at the radio device of the signal when the signal identifies a weather anomaly within the region of interest.

13. The method of claim 12 further comprising, prior to said accepting selection of the home geographical area, of selecting the home geographical area.

14. The method of claim 13 further comprising, prior to said selecting the home geographical area, of displaying on a user display geographical areas available to comprise the home geographical area, and wherein the home geographical area selected during said selecting is selected from the geographical areas displayed on the user display.

15. The method of claim 14 wherein said selecting comprises actuating a user actuator to select the home geographical area selected from the geographical areas displayed on the user display displayed during said displaying.

16. The method of claim 12 further comprising, prior to said accepting selection of the at least the first possible associated area, of selecting the at least the first associated area.

17. A method for facilitating operation of a radio device that operates to receive a signal selectably having a component that identifies an anomaly and having a geographic identifier of a first geographic area, said method comprising the operations of:

accepting selection of a home geographical area to be associated with the radio device;

automatically identifying possible associated areas in proximity to the home geographical area selected in the operation of accepting selection of a home geographical area, the possible associated areas being identified according to a proximity criterion;

selecting the at least the first associated area geographical area by at least selecting a first-stage set of geographical areas eligible to form the first associated area geographical area, and selecting a subset of the first-stage set, the subset forming the at least the first associated area geographical area;

accepting selection of at least a first associated area geographical area associated with the home area; and annunciating reception at the radio device of the signal when the signal contains the geographical identifier of the first geographical area in which the first geographical area identifies at least one of the home geographical area and the at least first associated area geographical area.

18. The method of claim 17 wherein said selecting the first-stage set is performed automatically and wherein said selecting the subset is user performed.

19. User interface apparatus for a weatherband radio operable to receive an alert signal selectably having a component that identifies weather anomalies and geographical areas as associated with the weather anomalies, said user interface apparatus comprising:

a user-actuated home geographical area selector configured to select, responsive to user actuation, a home geographical area;

an associated area selector adapted to receive an indication of the home geographical area, said associated area selector configured to automatically select at least one possible associated area associated with the home geographical area according to a selected proximity criterion, each selected possible associated area and the home geographical area forming a region of interest; and an annuciator for detecting reception at the radio device of the signal when the signal identifies a weather anomaly within the region of interest.

20. Apparatus for a radio device operable to receive a signal selectably having a component that identifies weather anomalies and geographical areas associated with the weather anomalies, said apparatus comprising:

a display configured to display indicia identifying geographical areas available for selection;

a home area selection acceptor actuatable by a user of the radio device, actuation of said user actuator by the user of the radio device identifying the selection of a home geographical area from geographical areas displayed on said display, said actuation accepted by said home area selection acceptor as the home geographical area to be associated with the radio device;

an associated area identifier configured to receive an indication of the home geographical area whose selection is accepted by said home area selection acceptor and to thereafter automatically identify on said display possible associated areas in proximity to the selected home geographical area according to a selected proximity criterion;

an associated-area selection acceptor actuatable by a user of the radio device, actuation of said associated-area selection acceptor by the user identifying a selection of a selected possible associated area displayed on said display as said associated area identifier, said selected possible associated area and the home geographical area forming a region of interest, the signal received by the radio device monitored for a weather anomaly within the region of interest.

21. The apparatus of claim 20 wherein the selected proximity criterion used by said associated area identifier comprises an adjacency indicia, possible associated areas identified by said associated area identifier adjacent to the home geographical area.

22. The apparatus of claim 20 wherein the selected proximity criterion used by said associated area identifier comprises a range indicia, geographical areas identified by said associated area identifier within a selected range of the home geographical area.

23. Apparatus for a radio device operable to receive a signal selectably having a component that identifies weather anomalies and geographical areas associated with the weather anomalies, said apparatus comprising:

a display configured to display indicia identifying geographical areas;

a home area selection acceptor configured to accept selection of a home geographical area to be associated with the radio device;

an associated area identifier configured to receive an indication of the home geographical area whose selection is accepted by said home area selection acceptor and to thereafter automatically identify and display on said display possible associated areas in proximity to the selected home geographical area according to one of possible associated areas identified by said associated area identifier adjacent to the home geographical area and geographical areas identified by said associated area identifier within a selected range of the home geographical area;

an associated-area selection acceptor adapted to receive an indication of the home geographical area whose selection is accepted by said home-area selection acceptor, and adapted to receive an indication of possible associated areas identified by said associated area identifier, said associated area selection acceptor configured to accept selection of at least a first possible associated area, each selected possible associated area and the home geographical area forming a region of interest, the signal received by the radio device monitored for a weather anomaly within the region of interest.

24. The apparatus of claim 23 further comprising a user actuator actuatable by a user of the radio device, selected actuation of said user actuator by the user of the radio device identifying the selection of the home geographical area that is accepted by said home area selection acceptor.

25. The apparatus of claim 24 wherein additional selected actuation of said user actuator by the user identifies the selection of the selected possible associated area.

* * * * *